US006055754A

United States Patent [19]

Melhuus

[11] Patent Number: 6,055,754

[45] Date of Patent: May 2, 2000

[54] DEVICE FOR MOUNTING LARGE POSTERS ON A BUILDING

[75] Inventor: Torgrim Melhuus, Trondheim, Norway

[73] Assignee: Torgrim Melhuus AS, Trondheim, Norway

[21] Appl. No.: 08/876,151

[22] Filed: Jun. 13, 1997

Related U.S. Application Data

[63] Continuation-in-part of application No. 08/513,811, filed as application No. PCT/NO95/00032, Feb. 14, 1995, abandoned.

[30] Foreign Application Priority Data

Mar. 1, 1994 [NO] Norway ..... 940698

[51] Int. Cl.[7] ..... G09F 7/00

[52] U.S. Cl. ..... 40/601; 40/602; 40/617; 40/470; 40/514; 160/290.1; 160/339; 160/349.1; 248/328

[58] Field of Search ..... 40/601, 602, 617, 40/470, 514, 515; 160/290.1, 339, 349.1; 248/328, 329

[56] References Cited

U.S. PATENT DOCUMENTS

| | | | |
|---|---|---|---|
| 591,281 | 10/1897 | Jutz | 40/617 |
| 662,089 | 11/1900 | Pettey | 40/617 X |
| 1,026,214 | 5/1912 | Koike | 40/466 |
| 1,072,799 | 9/1913 | Wall | 40/601 X |
| 1,340,066 | 5/1920 | Lemle | 160/331 |
| 1,671,880 | 5/1928 | Barnaby | 40/617 |
| 2,084,818 | 6/1937 | Neil | 40/602 X |
| 2,125,994 | 8/1938 | Doering | 40/601 X |
| 2,144,397 | 1/1939 | Taddonio | 40/601 X |
| 2,591,494 | 4/1952 | Asachika | 40/601 |
| 2,798,545 | 7/1957 | Busciolano | 160/339 X |
| 3,196,935 | 7/1965 | Christensen | 160/267.1 |
| 3,673,720 | 7/1972 | Thornton | 40/601 |
| 3,938,269 | 2/1976 | Catteau | 40/601 |
| 5,529,274 | 6/1996 | Anderson et al. | 248/329 |
| 5,870,845 | 2/1999 | Ruderman et al. | 40/601 |

FOREIGN PATENT DOCUMENTS

| | | | |
|---|---|---|---|
| 3423975 | 1/1986 | Germany . | |
| 64177 | 5/1913 | Switzerland | 160/339 |

*Primary Examiner*—Terry Lee Melius
*Assistant Examiner*—Andrea Chop
*Attorney, Agent, or Firm*—Pittenger & Smith, P.C.

[57] ABSTRACT

A large poster mounting frame is provided for displaying a poster along the wall of a building structure. The poster mounting frame comprises a pair of vertical side guide rails and a support rail extending between and connecting the two side guide rails. The frame can be mounted directly on the side of the building structure. The rails have a U-shaped cross-section with the open portion facing inwardly to form a continuous channel. A pair of grooved wheels are rotatably mounted on the support rail and hoist lines are directed over the grooved wheels and are connected to an upper poster carrying rail attached to the upper edge of a large poster. The lower edge of the poster includes a lower carrying rail. The hoist lines are used to raise the poster along with the upper and lower carrying rail into sliding contact with the side guide rails of the frame until the poster is securely mounted and displayed within the frame. Outwardly beveled ends and notches are provided in the bottom ends of the side guide rails to guide the carrying rails into the frame. A reversable motorized shaft can be used along with one or more support tapes for raising and lowering the large poster. A retaining device, such as a cord or net, may be provided across the front face of the side guide rails to further retain the poster within the mounting frame.

22 Claims, 5 Drawing Sheets

DEVICE FOR MOUNTING LARGE POSTERS ON A BUILDING

CROSS REFERENCES

This application is a Continuation-In-Part of my U.S. patent application Ser. No. 08/513,811, filed Nov. 1, 1996, which is abandoned, which is a 371 of PCT/NO95/00032, filed on Feb. 14, 1995.

FIELD OF THE INVENTION

The invention relates to a display device for removably mounting large size posters, pictures and similar articles, on vertical surfaces, particularly on exterior and interior walls of buildings.

BACKGROUND OF THE INVENTION

The need for displaying large advertising posters and photographs on building surfaces has increased. Until now the method of displaying these items has been done by glueing paper posters directly to a wall or to boards which are attached to a wall. This method is labor intensive and restrictive as to the area to be covered. It also requires repetitive work to remove the old item each time a new poster or photographic picture is to be applied. It is also known to apply posters on independent boards which are hoisted into a desirable position along the side of a wall.

SUMMARY OF THE INVENTION

The main object of the present invention is to provide a device for mounting or displaying large size posters, allowing the size of the poster to be increased and simplify the mounting and demounting work required.

It is another object of the present invention to provide a device for displaying large size posters, which in turn, makes it economically feasible to change posters at relatively short intervals.

An important element in the present invention is the use of flexible posters or pictures which have the ability to withstand the impact of rain and snow, and which have sufficient strength to allow them to be suspended from one edge. This may be achieved by laminating photographic paper with plastic foil on one side or both sides, or by applying the picture or poster on a textile web having adequate strength.

The present invention includes a large size information carrier device mounted to a vertical surface, such as a wall of a building or structure. The information carrier device comprises a frame portion having a pair of vertical side guide rails arranged in parallel and attached to a building wall. These side guide rails are U-shaped and have the open portion facing each other. A horizontal U-shaped support rail is provided as the top member of the frame and it interconnects and joins the two side guide rails.

An upper carrying rail is suspended between the two side guide rails by one or more hoist lines which are attached to the support rail and guided over rotating pulleys or grooved wheels which are rotatably mounted on the top frame or support rail. In the alternative, these wheels can be mounted directly to the side of the building itself. The opposite end of the hoist line extends to a position close to the ground whereby an individual can grasp the hoist line and lower the upper carrying rail to a position close to the ground.

In another embodiment, the invention can include a motorized lifting and lowering arrangement for mounting and demounting the large-size display. In this arrangement, an enclosed housing is mounted immediately above the support rail and two or more longitudinal slots are provided in the upper surface of the support rail. Mounted within the enclosure is an elongated rod or shaft connected to a reversible electric motor. Two or more tapes or cables are connected to the shaft and are arranged to extend downwardly through the enclosure and through the slots provided in the support rail to be connected to the carrying rail upon which the display is suspended. It has been found that a relatively wide solid or woven tape works quite well in this use in that it is easily wound on the support shaft and has considerable strength. Control wires extending from the motor can be independently mounted along the side of the building or can extend downwardly through one of the guide rails for the display. A control switch box and a connected power source to a convenient electrical outlet, or source of power, can be provided. Merely by switching the control box the motor can be energized to either raise or lower the display unit as desired. This arrangement provides a very easy and efficient way of activating the display. In addition, it locks and prevents the display from being activated by an unauthorized person which is possible with a manual type of lifting arrangement using ropes or cables.

A large size display item, such as a photograph or poster can be attached to the upper carrying rail which can be raised into position within the frame so that the upper carrying rail is guided along the parallel side rails and held in position securely in the top support frame rail. In this way, the display item is securely held in position within the frame on the side of the building without being damaged or deteriorated by environmental conditions.

Another feature of the present invention is the fact that various display items can be quickly removed and replaced with new items as desired.

The present device permits the display of very large posters on walls of building structures without requiring the use of ladders or a lifting platform. The posters are easily and quickly raised into the frame and are well protected against wind and other environmental influences.

BRIEF DESCRIPTION OF THE DRAWINGS

The present invention is described in more detail below with reference to the drawings, in which.

DETAILED DESCRIPTION OF THE INVENTION

Figure 1:
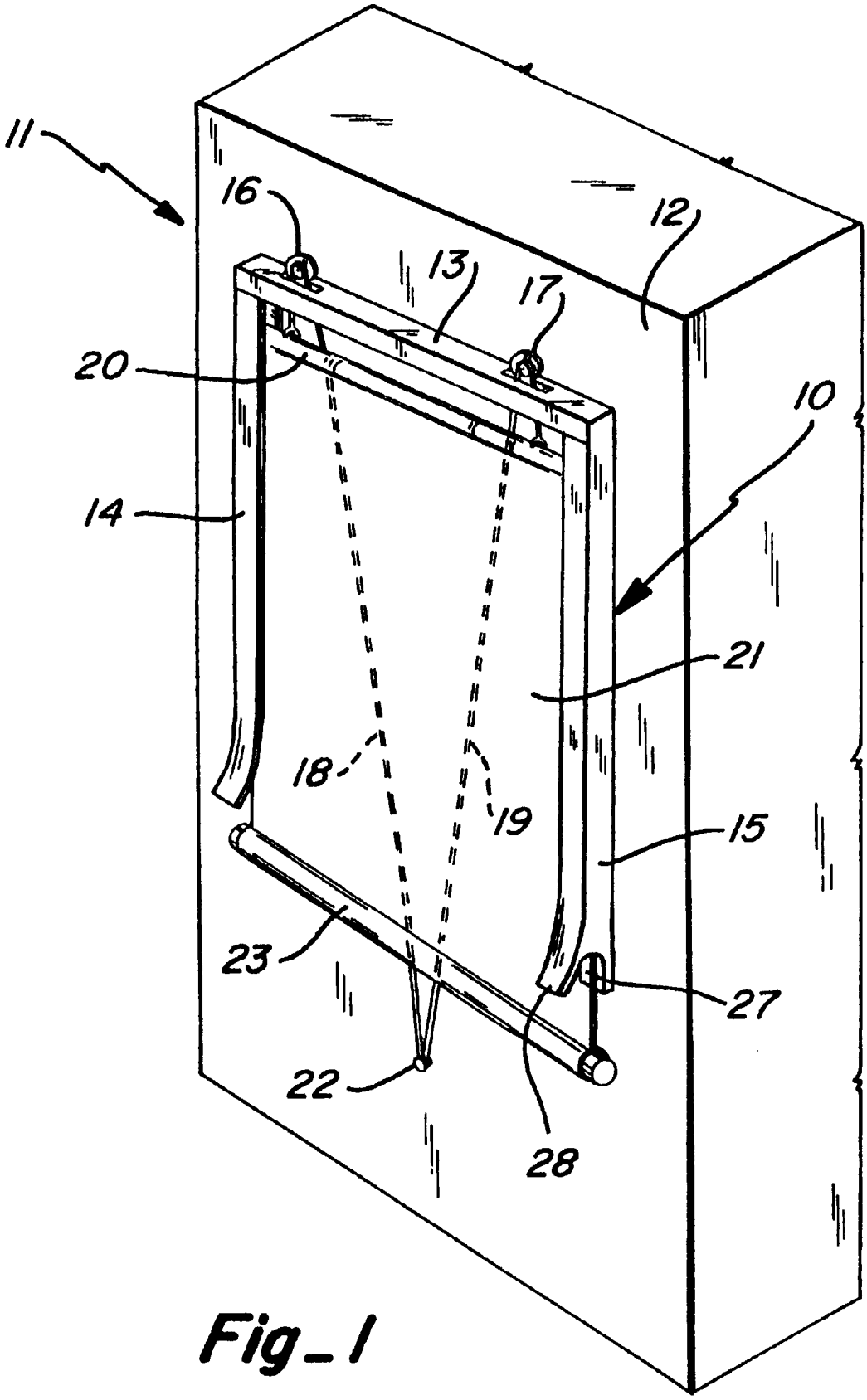
FIG. 1 shows a perspective view of a device according to the present invention mounted on the side of a multi-story building structure.

FIG. 1 shows a large-size display frame 10 securely attached to a wall 12 of a building structure 11. The large size display frame 10 includes an upper support rail 13 positioned horizontally and joined at each end by a pair of downwardly extending parallel guide elements or rails 14, 15. The guide rails 14, 15 and the upper support rail 13 each have a U-shaped cross-section with the open portion of the cross-section facing in the direction of the other rail. In this way, a three sided U-shaped channel is provided in making up the large-size display frame 10. The mounting frame 10 is attached to the wall 12 by lugs or fasteners (not shown). The support rail 13 can be provided with two grooved wheels 16, 17 which are rotatably mounted on the upper support rail 13 to support and guide the hoist lines 18, 19. Any number of hoist lines and wheels can be used in this invention.

Figure 2:
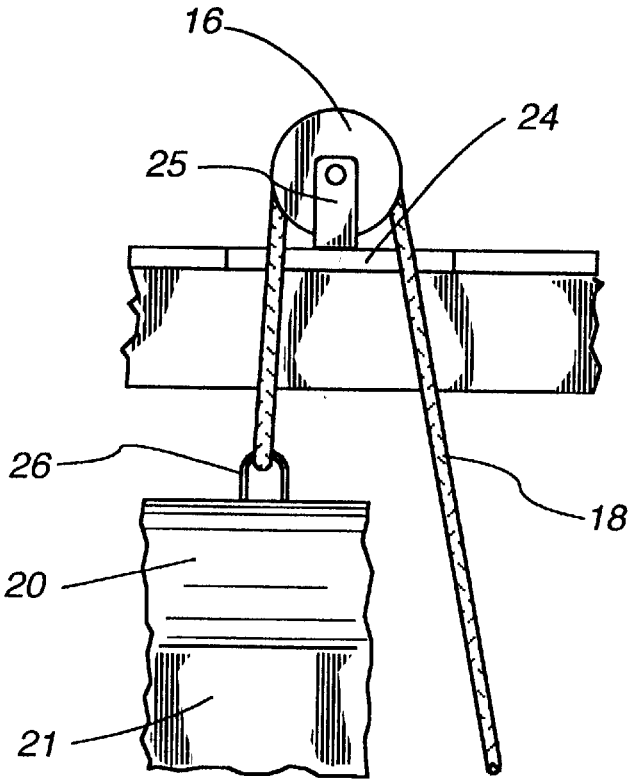
FIG. 2 shows a partial front view of the upper support rail.

As shown in FIG. 2, the grooved wheels 16, 17 are mounted on the top surface of the support rail 13 and a channel 24 is provided in the upper support rail 13 for the passage of the hoist lines 18, 19. It is also possible to mount the wheels 16, 17 within the frame rail to conceal them and protect them from the elements.

A cross-wise extending upper carrying rail 20 can be horizontally positioned with its ends slidably arranged within the side rails 14, 15. The end of each of the hoist lines 18, 19 are attached to the, upper cross-wise carrying rail 20 with the opposite ends of the hoist lines extending along the building side 12 and attached to a fastener 22 provided on the side of the building 11. The fastener 22 and the ends of the hoist lines 18, 19 are arranged to be conveniently accessed by a user.

A poster 21 which is to be displayed on the side wall 12 is fastened at its upper edge to the upper carrying rail 20. A lower carrying rail 23 is attached to the bottom edge of the poster to secure it by its weight so that the poster is smooth and stretched. As the upper carrying rail 20 is hoisted along the side rails 14, 15 by the hoist lines 18, 19, the lower carrying rail 23 is also pulled into the bottom ends of the side rails 14, 15 so that the bottom edge of the poster 21 and the bottom rail 23 will be held in position during the display of the poster 21.

FIG. 2 shows an opening or channel 24 in the surface of the support rail 13, with the grooved wheel 16 mounted on the top of the rail 13 by bracket 25. The hoist line 18 extends through the opening 24, over the grooved wheel 16 and down to a lug 26 attached to an upper portion of the upper carrying rail 20.

Figure 3:
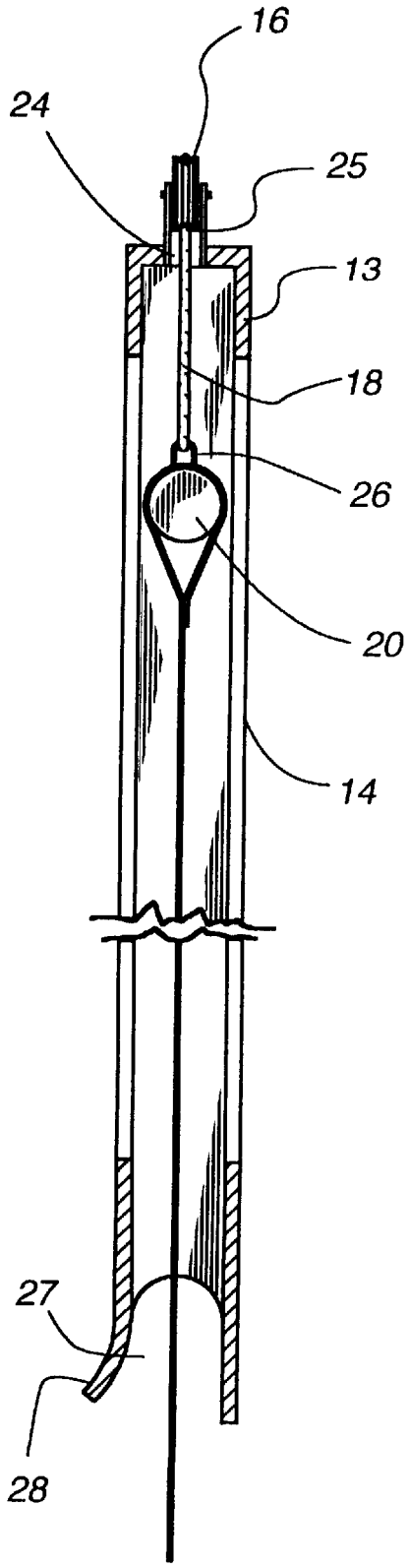
FIG. 3 shows a cross-sectional view of the device as shown in FIG. 1.

In FIG. 3, the lower ends of the guide rails 14, 15 include an indent or notch 27 having a rounded inner part to accommodate the ends of the upper and lower carrying rails 20, 23 and hold them in position close to the wall 12. The front flange of each of the guide rails 14, 15 has an outwardly beveled end 28 to create a conversion entering face.

Figure 4:
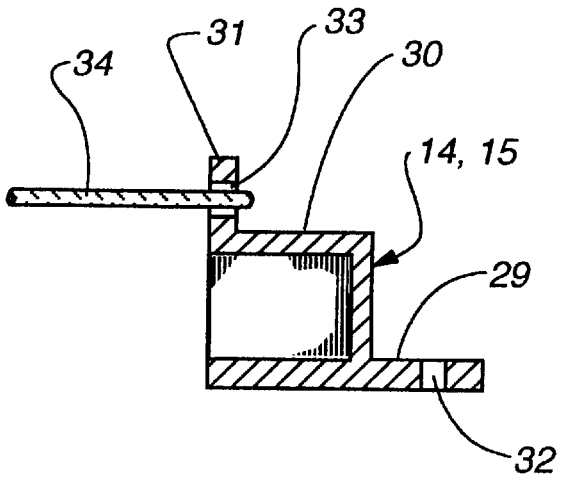
FIG. 4 shows a cross-sectional view through a side guide rail of the device.

In FIG. 4 is shown a profile of the guide side rails 14, 15. In this embodiment, the guide rails 14, 15 have an additional flange 29 in the plane of the wall 12, and the outer flange 30 includes a perpendicular flange 31 at the inner edge. The wall flange 29 is provided with openings 32 for screws or fasteners which securely mounts the frame 10 to the wall 12 of the building 11. The outwardly extending flange 31 is provided with a series of openings 33 along its entire length. The purpose of the openings 33 is to hold a cord or line 34 which is arranged in a zigzag-pattern between the side guide rails 14, 15. The purpose of the line 34 is to hold the poster 21 in place and prevent it from being disturbed by high wind. The cord or line 34 may be replaced by a net type material or other retainer similarly attached along the outer face of the guide rails 14, 15.

Figure 5:
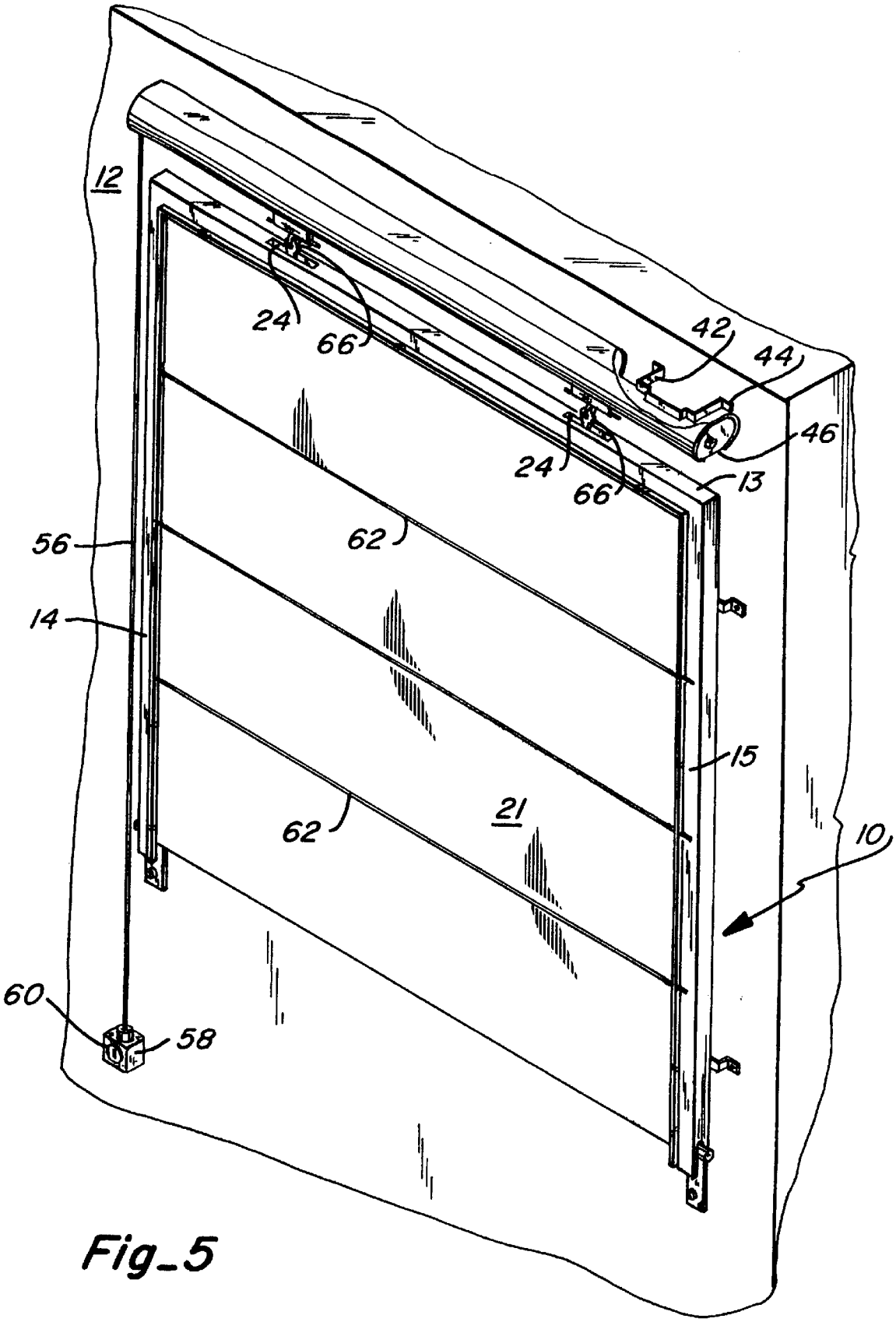
FIG. 5 is a perspective view of another embodiment of the display device according to the present invention showing an enclosure for the motorized lifting device.
Figure 6:
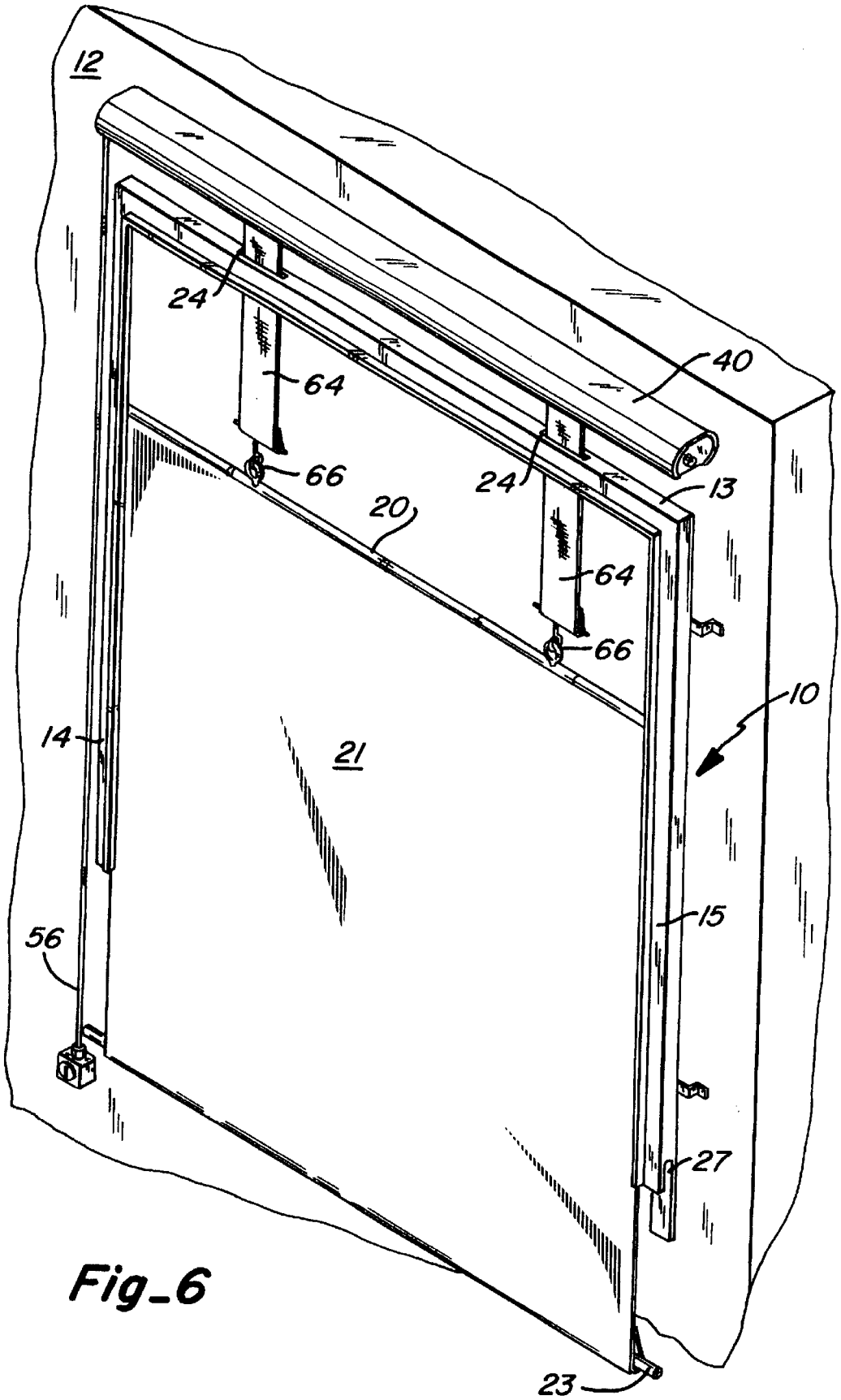
FIG. 6 is a perspective view showing the display partially supported by the lifting device.
Figure 7:
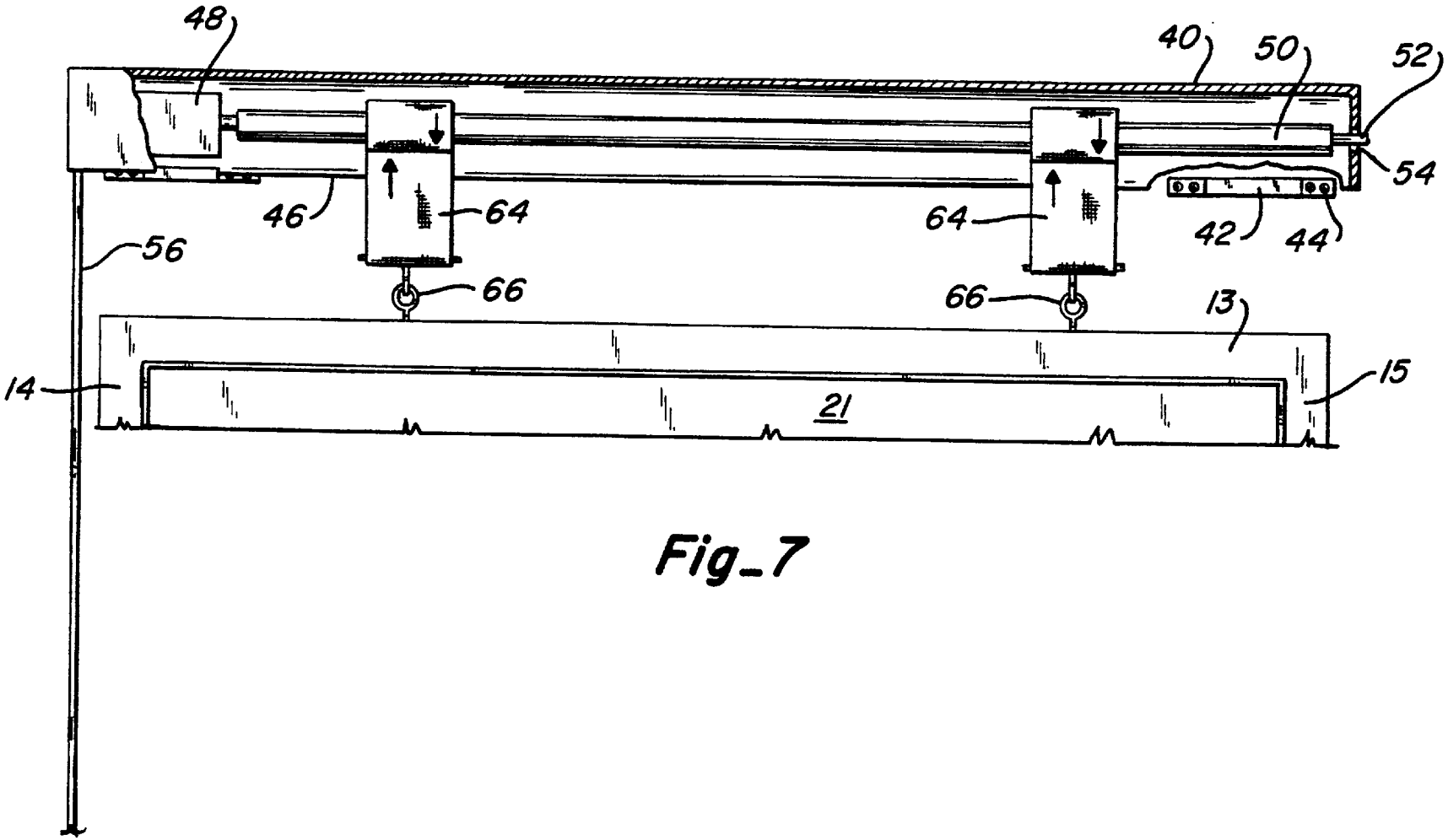
FIG. 7 is a front view of a partial sectional view of the motorized lifting device showing the tape support for the display.

In an alternative embodiment, a motorized lifting device can be substituted for the hoist lines 18, 19 and pulleys 16. As seen in FIG. 5, the large-size display frame 10, as illustrated in FIG. 1, includes the side guide rails 14, 15 and upper support rail 13. The support rail 13 is joined at each end by the pair of downwardly extending side guide rails 14, 15. All three of these rails include a U-shaped cross-section with the open portion of the cross-section facing inwardly in the direction of the other rails. In this way, a three side U-shaped channel is provided in making up the mounting frame 10. The mounting frame 10 is attached to the wall 12 by lugs or fasteners which were previously discussed.

A covered enclosure or housing 40 having a length which can be substantially the same as the width of the display 10 can be mounted to or slightly above the frame 10. The upper portion, sides and ends of the housing 40 are usually enclosed to preclude the possibility of dust, rain or snow from entering the housing. The bottom portion can be left open or provided with an elongated slotted opening 46.

Within the housing 40 is provided a reversible electric motor 48 and coupled shaft 50 mounted at the opposite end from the motor by a pin 52 extending through an aperture 54 provided in the housing 40. The pin 52 and aperture 54 help to support the end of the shaft 50 while the opposite end is supported by the motor 48. A control wire 56 extends from the motor 48 and housing 40 and is suitably guided and mounted along the wall 12 to the switch housing or control box 58. The switch housing 58 includes a key locked switch 60 which is connected to the control cable or wire 56 and in turn, to a suitable source of electrical power.

One or more support tapes 64 have one end securely attached to the shaft 50 and the opposite end attached through a suitable clip and eye connector 66 is attached to the upper carrying rail 20 supporting the display 21. The tapes 64 extend downwardly through slotted openings 24 provided in the support rail 13.

The length of the tape 64 is intended to extend to a position where the carrying rail 20 can be easily reached from the ground by a technician. Usually this is within 5-6 feet of the ground so that the old display device or poster can be readily exchanged for a new display. Once the exchange has been made, the tapes 64 can be wound on the shaft 50 to lift the display 21 upwardly through the side guide rails 14, 15 until it reaches the protection of the upper support rail 13. The length of the display and the coordinated length of the side rails 14, 15 are intended to allow the carrying rail 20 to enter into proper position in the support rail 13 while at the same time the lower carrying rail 23 which is attached to the bottom edge of the poster moves into the slotted end grooves 27, 28 provided at the bottom end of each of the side rails 14, 15.

It is also to be understood that any type of control can be used with the motorized embodiment that is described herein. It is possible to use a remote control system which could be either infrared or radio frequency controlled for operating the motorized arrangement. In these arrangements a suitable receiver would be housed within the housing 40 and suitably connected with the motor 48 for controlling the operation of the motor and thus, the installation and removal of the displays as desired. A hand held transmitter or "remote" could be used to actuate the receiver for this purpose.

It is also to be understood that the display, according to the present invention, is intended to encompass very large sizes. These arrangements can be as large as twenty-five feet high and twenty feet wide, or even larger, if desired. There is actually no limit to the size of the display that can be utilized and provided with the present invention. The only limitations would be in the materials that would be used especially for the display itself, which would have to have sufficient strength to be self-supporting so that the entire display can be suspended from the upper carrying rail 20. Also with the present invention, it is not necessary to enclose the frame in that the frame which is provided is not subjected to the elements and can successfully support and protect the display unit under most environmental conditions. This is one of the benefits of the present invention, in that a relatively inexpensive arrangement is provided to display extremely large posters which provides a very efficient method of advertising.

The groove or indent 27 may also be replaced by an arrangement, in which the ends of the lower carrying rail 23 are allowed to enter guide grooves provided in the lower ends of the side guide rails 14, 15 and arranged to abut suitable stop members positioned within the grooves. In this way, a more positive positioning is applied to the lower carrying rail to hold it stable at all times.

While a large size poster mounting frame has been shown and described in detail in this application, it is to be understood that this invention is not to be limited to the exact process and form disclosed and changes in the detail and construction of the invention may be made without departing from the spirit thereof.

What is claimed is:

1. A frame mounting device in combination with a support structure for displaying a large-size information sheet, the mounting device comprising;

a) a generally upright support structure;

b) an information sheet having an upper and lower edge and carrying one of information or a design for viewing by the public:

c) a support rail and two elongated parallel side guide rails all having a U-shaped cross-section and having an elongated open portion along one side and the open portions facing inwardly toward each other, each of said side guide rails being positioned generally vertical and having an upper end and an opposite lower end, said support rail being positioned horizontally above and between the upper ends of said guide rails to form a U-shaped frame, said support rail being directly attached to said support structure;

d) guide means being attached to said support rail, said guide means being one or more grooved wheels rotatably mounted on said support rail;

e) an upper and lower carrying rail for attachment to the upper and lower edges, respectively, of said information sheet, the upper carrying rail having a length which fits within and between the open portions provided in said guide rails; and f) a hoist line having one end attached to said upper carrying rail and passing over a grooved wheel of said guide means and extending downward along said support structure so that it can be easily gripped and pulled by a user so that the upper carrying rail and the attached information sheet can be raised from a lower, accessible position to a display position within said frame by pulling on the hoist line so as to position the upper carrying rail and said information sheet within the open portions provided in and between said guide rails so that said information sheet is secured and is highly visible when raised into said display position within said frame mounting device.

2. The combination as defined in claim 1 wherein said guide and support rails have an outwardly extending flange for mounting said rails to said support structure.

3. The combination as defined in claim 1 wherein a retaining means is provided along an outer face of said guide rails which is opposite to said support structure for retaining the information sheet in said display position against adverse environmental factors.

4. A frame mounting device in combination with a support structure for displaying a large-size information sheet, the mounting device comprising;

a) a generally upright support structure;

b) an information sheet having an upper and lower edge and carrying one of information or a design for viewing by the public;

c) a support rail and a plurality of elongated parallel guide rails all having a U-shaped cross-section with an elongated open portion along one side and the open portion of each rail facing inwardly toward each other, each of said guide rails being positioned generally vertical and having an upper end and an opposite lower end, said support rail being positioned substantially horizontal above and between the upper ends of said guide rails to form a U-shaped frame, said support rail being directly attached to the support structure;

d) an upper carrying rail and a lower carrying rail for attachment to the upper and lower edges, respectively, of the information sheet, the upper carrying rail having a length which fits within and between the open portions provided in said guide rails;

e) a hoist means being arranged for attachment to the upper carrying rail connected to said information sheet whereby the information sheet can be slidably moved between said guide rails to an upper display position and lowered to a lower accessible position beyond said guide rails whereby the information sheet can be attached or removed from said hoist means.

5. The combination as defined in claim 4 wherein the hoist means includes an elongated shaft drivingly connected to a drive motor, said motor being adapted to rotate said shaft in either direction as desired, said shaft being mounted above the support rail and a connecting means for extending from said shaft to the upper carrying rail attached to said information sheet whereby as the shaft is rotated the connecting means will be lengthened or shortened in order to raise and lower the information sheet.

6. The combination as defined in claim 5 wherein the motor includes a source of electric power and a control means arranged to be actuated by a user in order to raise and lower the information sheet from the upper display position to the lower accessible position.

7. The combination as defined in claim 6 wherein the control means is an electric switch mounted in an accessible position to a user for controlling the movement of the positioning of the information sheet.

8. The combination as defined in claim 6 wherein the control means is a receiver and a remote transmitter, the receiver can be actuated by the remote transmitter for controlling the motor and therefore, the position of the information sheet.

9. The combination as defined in claim 5 wherein the connecting means, forming a part of the hoist means is one or more connecting tapes which can be wound on said shaft in order to raise and lower said information sheet.

10. The combination as defined in claim 5 wherein the connecting means extends through one or more apertures provided in the support rail for attachment to the upper carrying rail.

11. The combination as defined in claim 4 wherein the lower carrying rail is longer than the space between the guide rails and an elongated notch is provided in the lower end of each of the guide rails whereby as the information sheet is raised into the display position the ends of the lower carrying rail will slidably move into a locking position in the elongated notch in the lower end of each of said guide rails.

12. The combination as defined in claim 4 wherein the hoist means is enclosed in a housing for protecting the hoist means from environmental conditions.

13. A device in combination with a support structure for displaying a large-size information carrier, such as a poster, said displaying device comprising;

a) a generally upright support structure;

b) a large-size information carrier comprising a sheet having a pair of opposite side edges and a pair of opposite upper and lower edges and arranged so that the sheet displays one of information or artistic presentations to a viewer;

c) a support rail and a pair of upright side guide rails attached to the support structure, each of said side guide rails having an upper and opposite lower end, said side guide rails having mutually facing grooves for receiving the side edges of the information carrier, said support rail being positioned between the upper ends of said side guide rails;

d) an upper carrying rail attached to the information carrier along at least a portion of its upper edge and a lower carrying rail attached to at least a portion of the lower edge of said information carrier;

e) hoisting means mounted directly to said support structure and above the upper ends of said guide rails, said hoisting means being attached to said upper carrying rail whereby the upper carrying rail and the information carrier can be slidably elevated within the grooves of said side guide rails for raising the information carrier from a lowered, accessible position to a generally upright exposed position so that it is visible to a viewer; and f) fastening means at the lower end of the side guide rails for holding the lower carrying rail to prevent the information carrier when in the generally upright position from being displaced or damaged by environmental factors.

14. The combination as defined in claim 13 wherein said support rail is a substantially horizontal U-shaped support rail having an elongated open slot and opposing ends, said elongated open slot is positioned downward and said support rail is positioned so that the opposing ends of the support rail are juxtapositioned to the upper ends of said side guide rails, the elongated open slot in said U-shaped support rail being sized to receive the upper carrying rail.

15. The combination as defined in claim 14 wherein the support rail is directly attached to the support structure.

16. The combination as defined in claim 14 wherein the hoisting means includes a plurality of hoist lines and a plurality of rotatable grooved wheels mounted on said support rail whereby one end of the hoist lines are attached to the upper carrying rail and are guided over separate grooved wheels so that an opposite end of each of said hoist lines is accessibly positioned whereby a user can pull on the hoist lines and raise the information carrier from the lowered position near a ground surface to the upright exposed position wherein the information carrier is slidably positioned between the side guide rails with the upper carrying rail and upper edge of the information carrier positioned at the support rail.

17. The combination as defined in claim 13 wherein the side guide rails have a U-shaped cross-section, and the side guide rails have an outwardly extending side flange for mounting the rails to the support structure.

18. The combination as defined in claim 13 wherein the upper carrying rail has a length which will fit between the side guide rails and the lower carrying rail has a length which exceeds the space between said side guide rails, said fastening means includes a flange provided at the lower ends of said guide rails which is beveled outward from said support structure to form an incline entering face for the upper and lower carrying rails and the lengths of said side guide rails are predetermined so that when the upper carrying rail is positioned adjacent to said support rail the ends of the lower carrying rail will firmly fit under the flange on each of said side guide rails so that the lower carrying rail is held in a secure and rigid position.

19. The combination as defined in claim 13 wherein the side guide rails are provided with an outwardly extending flange having openings along the entire length of the side guide rails for attaching a retaining means between the guide rails for holding the information carrier in position against environmental factors.

20. A device for displaying a large-size information carrier, such as a poster, on a generally upright support structure, said device comprising:

a) a generally upright support structure;

b) an information carrier comprising a sheet having opposite side edges and upper and opposite lower edges and arranged so that the sheet provides one of information or artistic presentations to a viewer, c) a pair of upright side guide rails attached to the support structure, each of said guide rails having an upper and opposite lower end, said guide rails having mutually facing grooves for receiving the side edges of the information carrier;

d) an upper carrying rail attached to the information carrier along at least a portion of its upper edge and a lower carrying rail attached to at least a portion of the lower edge of said information carrier;

e) hoisting means mounted on said support structure and attached to said upper carrying rail whereby the upper carrying rail and the information carrier can be slidably elevated within the grooves of said upright guide rails for supporting the information carrier in an upright position so that it is visible to the viewer;

f) fastening means at the lower end of the guide rails for holding the lower carrying rail to prevent the information carrier, when in the upright position, from being displaced or damaged by environmental factors; and g) the side guide rails are provided with an outwardly extending flange having openings along the entire length of the side guide rails for attaching a retaining means between the guide rails for holding the information carrier in the upright position against environmental factors.

21. A frame mounting device for displaying a large-sized information sheet, on an upright support structure, the mounting device comprising:

a) a generally upright support structure;

b) an information sheet comprising a sheet having upper and opposite lower edges and arranged so that the sheet provides one of information or artistic presentations to a viewer;

c) a support rail and a plurality of elongated parallel guide rails all having a U-shaped cross-section and having an elongated open portion along one side and the open portion of each rail facing inwardly toward each other, each of said guide rails being positioned generally vertical and having an upper end and an opposite lower end, said support rail being positioned substantially horizontal and above and between the upper ends of said guide rails to form a U-shaped frame, said frame being attached to the support structure;

d) an upper and a lower carrying rail for attachment to the upper and lower edges, respectively, of the information sheet, the upper carrying rail having a length which fits within and between the open portions provided in said guide rails;

e) a hoist means being arranged for attachment to the upper carrying rail which is attached to said information sheet whereby the information sheet can be slidably raised between said guide rails to an upper display position and lowered to a lower position beyond said guide rails whereby the information sheet can be attached or removed from said hoist means;

f) said hoist means having an elongated shaft connected to a drive motor means, said motor means being adapted to rotate said shaft in either direction as desired, said shaft being mounted above the support rail and a connecting means extends from said shaft to the upper carrying rail attached to said information sheet whereby as the shaft is rotated the connecting means will be lengthened or shortened in order to raise or lower the information sheet, said connecting means includes one or more connecting tapes which can be wound on said shaft in order to raise and lower said information sheet; and g) said shaft and motor means are positioned parallel to the support rail and elongated slots are provided in the support rail to allow passage of the connecting tapes for positioning said information sheet.

22. A frame mounting device, for displaying a large-size information sheet, on an upright support structure, the mounting device comprising:

a) a generally upright support structure;

b) a large-size information sheet having side edges and an upper and lower edge and carrying information or a design for viewing by the public;

c) a support rail and a plurality of elongated parallel guide rails all having a U-shaped cross-section having an elongated open portion along one side and the open portion of each rail facing inwardly toward each other, each of said guide rails having an upper end and an opposite lower end, said support rail being positioned substantially above and between the upper ends of said guide rails to form a U-shaped frame, said support rail being directly attached to the support structure;

d) an upper and lower carrying rail for attachment to the upper and lower edges, respectively, of the information sheet, the upper carrying rail having a length which fits within and between the open portions provided in said guide rails; and e) a hoist means being arranged for attachment to the upper carrying rail connected to said information sheet whereby the information sheet can be slidably raised between said guide rails to an upper display position and a lower, accessible position beyond said guide rails whereby the information sheet can be attached or removed from said hoist means.

* * * * *